US006048612A

United States Patent [19]

Dozier

[11] Patent Number: 6,048,612

[45] Date of Patent: Apr. 11, 2000

[54] ARTICLE FOR ENHANCING AN ATHLETIC GRIP

[76] Inventor: Michael D. Dozier, 1600 Contra Costa Blvd., Suite A, Pleasant Hill, Calif. 94523

[21] Appl. No.: 09/130,964

[22] Filed: Aug. 7, 1998

[51] Int. Cl.[7] ..... B32B 7/10; B32B 27/12; B32B 33/00

[52] U.S. Cl. ..... 428/355 R; 428/343; 442/101; 442/149; 442/151; 106/36; 427/207.1; 427/208.4; 427/208.6; 156/230; 156/234; 156/326

[58] Field of Search ..... 428/343, 355 R; 442/101, 149, 151; 106/36; 427/207.1, 208.4, 208.6; 156/230, 234, 326

[56] References Cited

U.S. PATENT DOCUMENTS

| | | | |
|---|---|---|---|
| 2,754,532 | 7/1956 | Kanehl et al. | 15/209 |
| 4,563,218 | 1/1986 | Schuler | 106/36 |
| 5,000,452 | 3/1991 | Kuebler | 273/73 J |
| 5,364,677 | 11/1994 | Sendziak | 428/40 |
| 5,429,703 | 7/1995 | Hartman et al. | 156/294 |
| 5,435,549 | 7/1995 | Chen | 273/75 |
| 5,524,885 | 6/1996 | Heo | 473/299 |

*Primary Examiner*—Vivian Chen
*Attorney, Agent, or Firm*—Theodore J. Bielen, Jr.

[57] ABSTRACT

An article for enhancing an athletic implement grip where the article comprises a carrier material which is impregnated with a mixture utilizing a tacky adhesive and a thickener. The mixture is applied in sufficient quantities to the grip so as to permit retention of a portion of the mixture to the carrier and removal of a portion of the mixture when the impregnated carrier material contacts an athletic implement grip.

8 Claims, 1 Drawing Sheet

ARTICLE FOR ENHANCING AN ATHLETIC GRIP

BACKGROUND OF THE INVENTION

The present invention relates to a novel and useful article for enhancing the grasping of an athletic implement grip.

Various athletic implements such as rackets, clubs, bats, handle bars, and the like all require gripping by the user of the equipment. In the past, portions of the athletic implements which must be grasped have been wrapped with tape, cloth, and other materials which tend to provide a friction surface and which are capable of absorbing moisture emanating from the sweat in the user's hand.

For example, U.S. Pat. Nos. 5,000,452, 5,364,677, 5,429,703, 5,435,549, and 5,524,885 describe various grips which are normally wrapped around the handles of sports equipment rackets and clubs to permit better control of the same.

U.S. Pat. No. 2,754,532 describes a sportsman towel which is employed to clean sports equipment.

U.S. Pat. No. 4,563,218 shows a rosin-like material which is applied to the handle of sporting apparatuses such as tennis rackets to maintain the anti-slip effectiveness of the grip.

Unfortunately, use of wraps or cloth over a gripping surface of an athletic implement maintains its grasping characteristics for a short time due to wear and to sweat produced by the user of the athletic equipment. In addition, the use of rosin-like material in loose form is inefficient and inconvenient. In addition, such rosiness material tends to deteriorate over a short period of time with decrease usefulness of the grip as a result.

An article for enhancing the grasping of athletic implements would be a notable advance in the sporting field.

SUMMARY OF THE INVENTION

In accordance with the present invention a novel and useful article for enhancing the grasping of an athletic implement grip is herein provided.

The article of the present invention utilizes a carrier material which may be in the form of a cloth, such as cheese cloth or terry cloth. The carrier material may be formed into a convenient size and provided with a selvedge for convenience and durability. The carrier material in such format may be easily carried by the user of athletic equipment such as a golfer or tennis player.

The carrier material is combined with a mixture that is applied to the material in sufficient quantities to permit retention of the mixture within the material. However, the mixture of the present invention is also capable of being removed from the carrier material, in certain quantities, when the carrier material is contacted or rubbed on an athletic grip. The mixture includes a tacky adhesive and a thickener, and in certain cases, may also include a wetting agent. For example, the tacky adhesive may comprise 40 to 90 weight percent of the mixture while the thickener may comprise 10 to 60 weight percent of the mixture. With the addition of a wetting agent, the tacky adhesive may comprise 40 to 90 weight percent of the mixture, the thickener 70 to 30 weight percent of the mixture, and the wetting agent 3 to 30 percent of the mixture. In one embodiment of the invention, the tacky adhesive may comprise ditridecyl phthalate and the thickener may be polyethylene glycol fatty acid. Moreover, the wetting agent may take the form of dodecyl benzene sulfonate. In any case, it is important that the mixture used with the cloth carrier possess the retention and removal qualities hereinabove described when the combined carrier and mixture contacts an athletic grip.

It may be apparent that a novel and useful article for enhancing the grasping of an athletic implement grip has been described.

It is therefore an object of the present invention to provide an article for enhancing the grasping of an athletic implement grip which may be easily and conveniently carried by the user of the athletic equipment.

Another object of the present invention is to provide an article for enhancing the grasping of an athletic implement grip which is in the form of a cloth carrier combined with a mixture that slowly transfers an adhesive in the mixture to the athletic grip at each contact of the carrier material with the implement grip.

Yet another object of the present invention is to provide an article for enhancing the grasping of an athletic implement grip which does not deteriorate over the reasonable period of time and maintains its ability to enhance the grasping of an athletic implement grip during this period of time.

Another object of the present invention is to provide an article for enhancing the grasping of an athletic implement grip which is relatively simple to manufacture and distribute.

The invention possesses other objects and advantages especially as concerns particular characteristics and features thereof which will become apparent as the specification continues.

Figure 1:
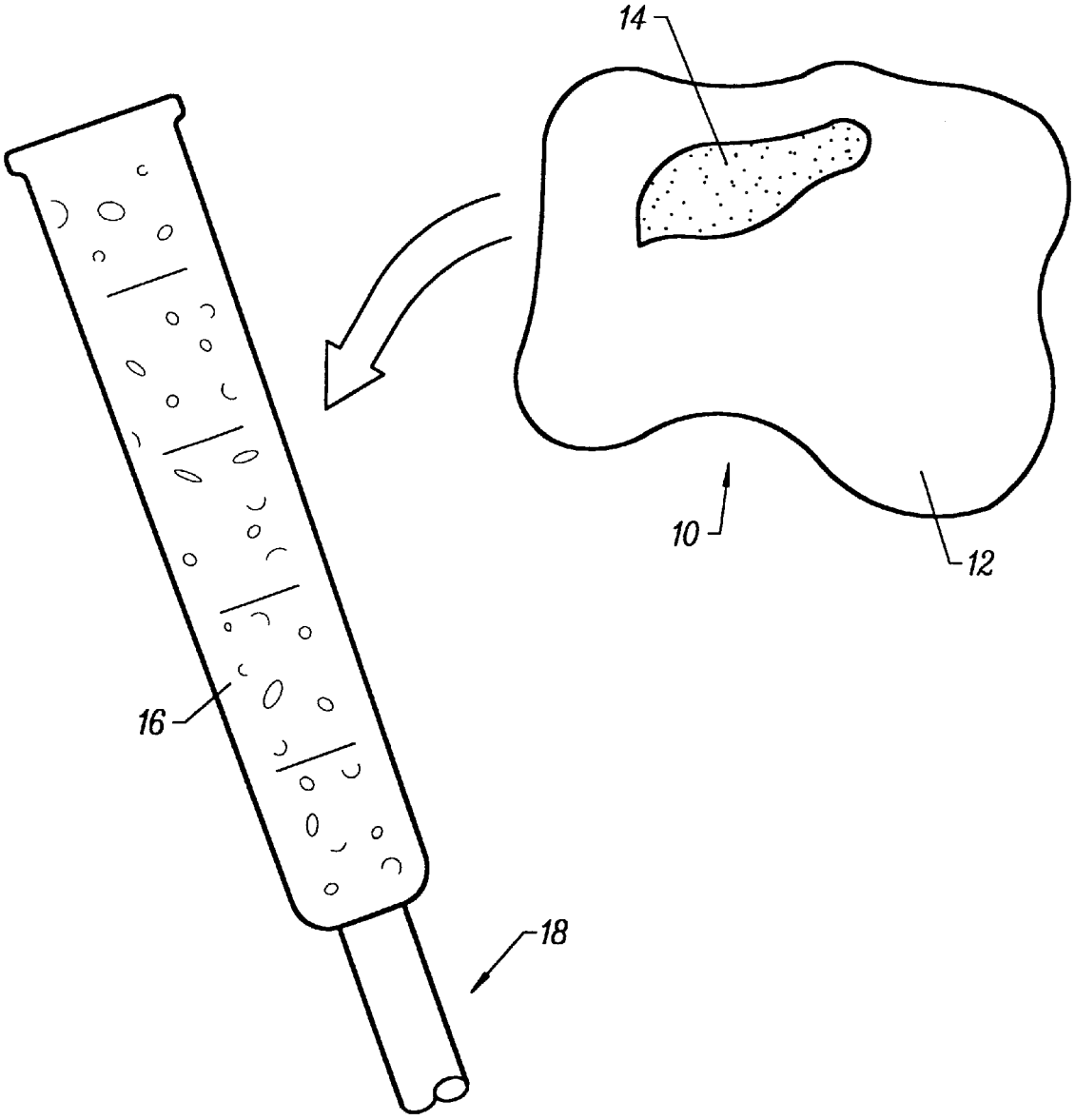
FIG. 1 is a side elevational view of a portion of a golf club grip and the article of the present invention intended for use therewith.

For a better understanding of the invention references made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be understood in connection with the prior described drawings.

The invention as a whole is depicted in FIG. 1 of the drawing by reference character 10. Article 10 includes a carrier material 12 which may be a cloth such as terry cloth, cheese cloth, linen, and the like. Cloth carrier 12 must maintain a certain resiliency and durability for use over a period of time.

Carrier material 12 is combined with a mixture 14 which is depicted schematically in FIG. 1 by stippled area. Mixture 14 includes a tacky adhesive and a thickener. In certain cases the tacky adhesive and thickener are combined with a wetting agent. The tacky adhesive may take the form of a material which is capable of remaining in cloth carrier 12 and is also capable of being transferred, in part, to grip 16 of golf club 18. For example, when the cloth carrier 12 and mixture 14 applied thereto contacted on grip 16 a portion of mixture 14 coats grip 16 to provide a friction surface. For example, the tacky adhesive may take the form of ditridecyl phthalate or other like adhesives. The thickener may also be in the form of polyethylene glycol fatty acid and other like thickeners. When a wetting agent is used to promote impregnation of the mixture in 14 carrier material 12, wetting agent may be in the form of dodecyl benzene sulfonate or other like materials.

It has been found that mixture 14 may be applied to carrier material 12 where the tacky adhesive portion of the mixture comprises 40 to 90 weight percent, and the thickener comprises 10 to 60 weight percent of the mixture. When a wetting agent is employed in mixture 14, the tacky adhesive comprises 40 to 90 weight percent, the thickener comprises 7 to 30 weight percent, and the wetting agent comprises 3 to 30 percent of the mixture.

In operation, carrier material 12, impregnated with mixture 14 to form article 10, is simply rubbed or contacted on grip portion 16 of golf club 18, or the gripping portion of other athletic implements such as tennis rackets, bicycle handle bars, baseball bats, and the like. It has been found that article 10 will not adhere to athletic grips, but merely transfer a portion of the adhesive mixture 14 found therewithin each time the grip is contacted.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The following examples are deemed to be illustrative of the invention, but are not intended to limit the scope of the invention in any manner.

EXAMPLE I

The mixture of the present invention as combined in which ditridecyl phthalate comprised 70 percent by weight of the mixture, the thickener polyethylene glycol fatty acid comprised 20 percent of the mixture and a wetting agent dodecyl benzene sulfonate comprised 10 percent of the mixture. A sample of the mixture was applied to terry cloth by soaking the same in the mixture for a period of about 10 minutes. The formed article was then applied to the handles of a golf club having a leather grip, a tennis racket having a leather grip, and a Louisville Slugger baseball bat formed of wood. The athletic grips of each athletic implement were then tested for grasping qualities. It was determined that there was a marked increase in the ability to grasp each athletic implement after use with the article formed in this example. The article was stored in a plastic container. The contact of the article formed in this example to the athletic implements was repeated after a period of about two weeks with the same results.

EXAMPLE II

The mixture of Example I was applied to a cloth carrier formed of cheese cloth by spraying. The impregnated cheese cloth forming the article of the present invention was then applied to the leather athletic grips of a golf club, a tennis racket, and a wooden baseball bat, as in Example I. Similar results were achieved as that delineated in Example I.

What is claimed is:

1. An article for enhancing the grasping of an athletic implement grip, comprising:

a. a carrier material;

b. a mixture applied to said carrier material in sufficient quantities to permit retention of a portion of said mixture of said carrier material and removal of a certain portion of said mixture from said carrier material when said carrier contacts the athletic implement grip, the mixture comprising a tacky adhesive, and a thickener.

2. The article of claim 1 which said mixture additionally comprises a wetting agent.

3. The article of claim 2 in which said tacky adhesive comprises 40 to 90 weight percent of said mixture, said thickener comprises 7 to 30 weight percent of said mixture, and said wetting agent comprises 3 to 30 weight percent of said mixture.

4. The article of claim 3 in which said tacky adhesive is ditridecyl phthalate, said thickener is polyethylene glycol fatty acid, and said wetting agent is dodecyl benzene sulfonate.

5. The article of claim 1 in which said carrier material is a cloth.

6. The article of claim 1 in which sid tacky adhesive comprises 40 to 90 weight percent of said mixture, and said thickener comprises 10 to 60 weight percent of said mixture.

7. The article of claim 1 in which said tacky adhesive is ditridecyl phthalate.

8. The article of claim 1 in which said thickener is polyethylene glycol fatty acid.

* * * * *